United States Patent [19]

Chino et al.

[11] Patent Number: 4,825,825

[45] Date of Patent: May 2, 1989

[54] OIL PAN ARRANGEMENT FOR HORIZONTALLY MOUNTED ENGINE

[75] Inventors: Yoshiharu Chino, Toyota; Nobuaki Wakita, Nagoya; Masaru Hibino; Taro Ikeya, both of Okazaki; Toshiro Kanesaka; Kazuo Takeuchi, both of Toyota, all of Japan

[73] Assignee: Toyota Jidosha Kabushiki Kaisha, Aichi, Japan

[21] Appl. No.: 107,508

[22] Filed: Oct. 13, 1987

[30] Foreign Application Priority Data

Oct. 15, 1986 [JP] Japan ..... 61-156636[U]

[51] Int. Cl.[4] ..... F02F 7/00

[52] U.S. Cl. ..... 123/195 C; 123/195 HC; 123/196 W

[58] Field of Search ..... 123/195 HC, 195 AC, 123/196 W, 195 C; 184/106, 6.5

[56] References Cited

U.S. PATENT DOCUMENTS 3,106,263 10/1963 McKellar ..... 184/106
4,446,828 5/1984 Bauder et al. ..... 123/195 HC
4,523,556 6/1985 Suzuki ..... 123/196 W

FOREIGN PATENT DOCUMENTS 0005711 9/1954 Japan .
0019902 12/1959 Japan .
0036333 12/1971 Japan .
0029210 4/1973 Japan .

*Primary Examiner*—Willis R. Wolfe
*Assistant Examiner*—M. Macy
*Attorney, Agent, or Firm*—Kenyon & Kenyon

[57] ABSTRACT

An arrangement and structure for an oil pan system to permit mounting a vertical in-line engine in a vehicle in a horizontal or nearly horizontal attitude includes a cylinder block of the engine having an opening on the side wall thereof, a cover attached to the cylinder block where an ordinary oil pan is usually mounted, an adapter plate fastened to the lower side wall of the cylinder block and bottom of the cover, and an oil pan attached to the lower surface of the adapter plate. The adapter plate allows the oil pan to extend and always remain below the cylinder block, so that the return paths from the lubricated portions of the engine to the oil pan are shortened.

10 Claims, 5 Drawing Sheets

OIL PAN ARRANGEMENT FOR HORIZONTALLY MOUNTED ENGINE

BACKGROUND OF THE INVENTION

Field of the Invention

The present invention relates to an arrangement and structure for an oil pan system of a vertical in-line engine when the engine is mounted in a vehicle in a horizontal or nearly horizontal attitude.

Description of the Prior Art

Japanese Patent Publication SHO 29-5711, Japanese Utility Model Publications SHO 34-19902 and SHO 46-36333 and Japanese Utility Model unexamined Publication SHO 48-29210 disclose engines which are designed originally as horizontal engines, that is, as engines intended to be mounted in a vehicle so that the pistons reciprocate in a horizontal or nearly horizontal direction. In such horizontal engines, a part of the lower side wall of the cylinder block is formed as an oil pan, or an oil pan is directly attached to the lower side wall of the cylinder block of the mounted engine.

However, when an engine which is originally designed as a vertical in-line engine is mounted in a horizontal or nearly horizontal attitude in order to conform to space available for the engine in a vehicle, an arrangement and construction has been adopted as described in the following.

FIG. 6 shows a conventional structure of a vertical in-line engine 1 with the engine mounted in a vehicle in a normal attitude, that is, uprightly. The engine 1 has a cylinder head 2, a cylinder block 3, an oil pan 4 and a piston 5. Cylinder block 3 has an opening 6 used for removing casting sand on a side wall of the cylinder block, and the opening is closed by a plug 7. An appropriate amount of oil 8 is contained in oil pan 4, and the oil level of the oil in the oil pan can be maintained at an adequate level during driving.

If the engine 1 is mounted in a vehicle in an inclined attitude keeping the construction as it is, as shown in FIG. 7, it becomes difficult to maintain the amount and the level of the oil in the oil pan 4 at adequate values. Therefore, when a vertical in-line engine is mounted in a horizontal or nearly horizontal attitude, an arrangement and structure for an oil pan system, such as a construction as shown in FIG. 8, has been adopted. In FIG. 8, an attachment member 9 is provided on the bottom portion of the cylinder block 3 , and an oil pan 10 is attached to the lower portion of the attachment member. The attachment member and the oil pan may be integrated.

In such an engine as shown in FIG. 8, however, the time for return of oil to the oil pan 10 tends to increase, because the distance (L) between the oil pan and the farthest portion to be lubricated (in this case, it is a valve mechanism) becomes greater. If the return of oil takes longer, it becomes difficult to maintain the oil level in the oil pan 10 at an adequate level, and the amount of oil to be initially contained in the oil pan must be increased.

When a vehicle mounted with an engine in the attitude shown in FIG. 8 is inclined or turned, oil in the engine may reach the state as shown in FIG. 9. That is, a large amount of oil in the oil pan 10 flows into the cylinder block 3 and/or the cylinder head 2 when the vehicle is inclined or turned, and a fairly large part of the shifted oil remains in pockets in the cylinder block and/or the cylinder head. Since this decreases the amount of oil in the oil pan 10, the delivery of oil from the oil pan to various portions of the engine may be interrupted. Also, there is a fear that increased energy loss due to interference between the displaced oil and the moving parts of the engine may deteriorate engine performance.

SUMMARY OF THE INVENTION

An object of the present invention is to provide an arrangement and structure for an oil pan system which can improve return of oil to an oil pan, can prevent a large amount of oil from being trapped in various portions of the engine, and can maintain an oil level in the oil pan required for delivering the oil to all parts of a vertical in-line engine that is mounted in a horizontal or nearly horizontal attitude.

To accomplish the above object, an arrangement and structure for an oil pan system when a vertical in-line engine is mounted in a vehicle in a horizontal or nearly horizontal attitude, according to the present invention, the engine having a cylinder block with a lower side wall forming part of a crankcase and having an opening therethrough, the opening facing downward, comprises:

a cover attached to the cylinder block at a location which corresponds to the location where an ordinary oil pan would be attached when the engine is vertically mounted, the cover having an opening at a bottom portion thereof;

an adapter plate having an upper surface attached to the lower side wall of the cylinder block and to the bottom portion of the cover, the adapter plate extending at least from the opening in the lower side wall of the cylinder block to the opening in the bottom portion of the cover, the adapter plate having a first communication hole communicating with the opening of the cylinder block and a second communication hole communicating with the opening of the cover; and an oil pan attached to a lower surface of the adapter plate, the inside of the oil pan communicating with both openings via the first and second communication holes.

The opening in the lower side wall portion of the cylinder block is, for example, an opening used for removing casting sand.

In this arrangement and structure of oil pan system, by providing an adapter plate that is attached to the lower side wall of the cylinder block and the cover, an oil pan extending below the cylinder block and below the cover can be attached to the adapter plate, even though the engine is originally designed as a vertical in-line type engine. Since the adapter plate has communication holes communicating with the opening of the cylinder block and the opening of the cover, oil from various portions of the engine is returned into the oil pan through the openings and the communication holes. In particular, the opening of the cylinder block is located on the lower-positioned side wall of the cylinder block, and the oil pan is positioned just under that opening, that is, directly under the cylinder block. Therefore, the distances from various portions in the engine to the inside of the oil pan can be shortened as compared with not only the arrangement shown in FIG. 8 but also the conventional state in which the engine is uprightly mounted as a vertical in-line engine. As a result, the return of oil to the oil pan can be improved.

Moreover, since the oil pan is always positioned below the cylinder block, the oil in the oil pan can be prevented from undesirably running into the cylinder head or other portions. Namely, since the oil pan is always located under the lowest part of the engine, and the inside of the oil pan always communicates with the opening of the cylinder block and the opening of the cover through the communication holes of the adapter plate, the oil pumped to the cylinder head or other portions always returns into the oil pan smoothly and without flowing backward, even if the vehicle is inclined or turned.

As a result, this arrangement of the oil pan system both maintains an adequate amount of oil in the oil pan and assures a proper oil level in the oil pan.

BRIEF DESCRIPTION OF THE DRAWINGS

The above and other objects, features and advantages of the present invention will become apparent and more readily appreciated from the following detailed description of the preferred exemplary embodiments of the invention, taken in conjunction with the accompanying drawings, in which.

DETAILED DESCRIPTION OF THE PREFERRED EMBODIMENTS

Some preferred embodiments of the present invention will be described hereunder with reference to the attached drawings.

Figure 1:
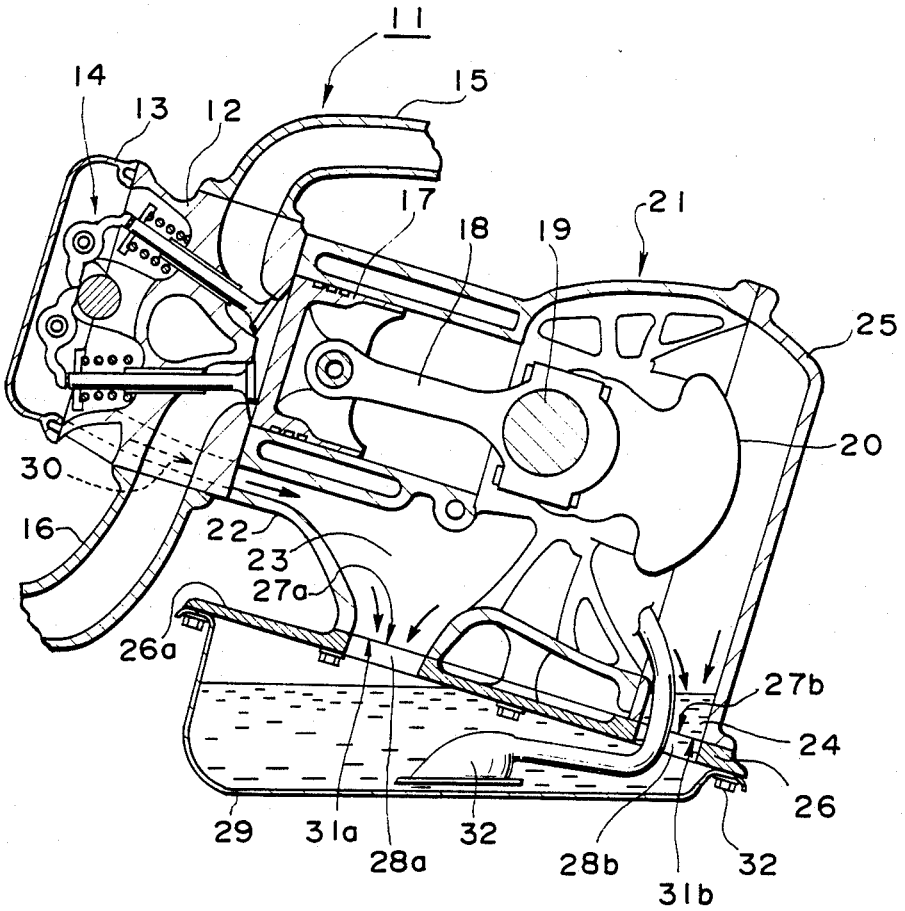
FIG. 1 is a vertical sectional view of an engine according to an embodiment of the present invention.
Figure 2:
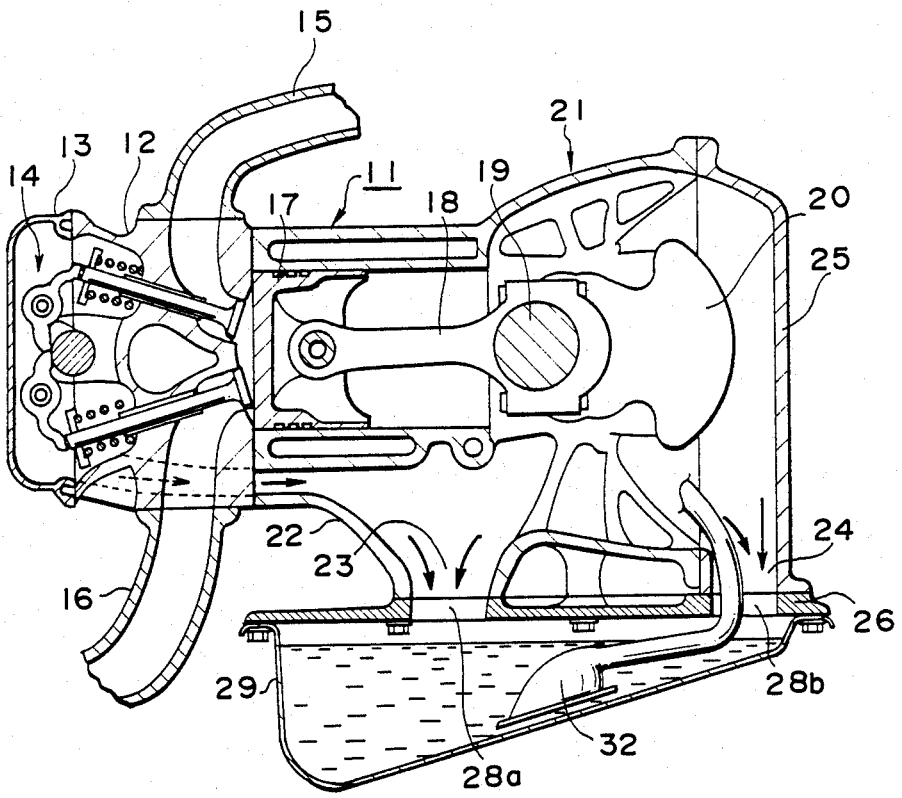
FIG. 2 is a vertical sectional view of the engine shown in FIG. 1, showing a state when a vehicle is inclined or turned.
Figure 3:
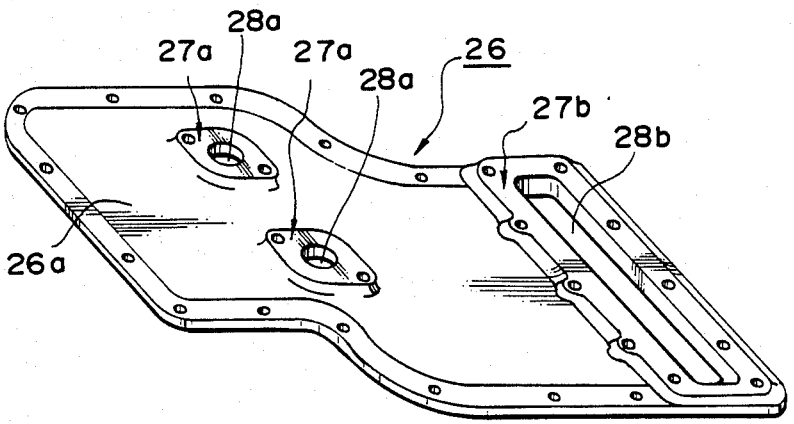
FIG. 3 is a perspective view of an adapter plate for an oil pan system of the engine shown in FIG. 1.

FIGS. 1 to 3 show an arrangement and structure for an oil pan system according to an embodiment of the present invention. Numeral 11 refers to a main body of an engine which is designed as a vertical in-line engine. The engine 11 has a cylinder head 12, a head cover 13, valve mechanism 14 provided on the cylinder head, intake manifold 15, exhaust manifold 16, piston 17, connecting rod 18, crankshaft 19, balance weight 20 and cylinder block 21.

Figure 6:
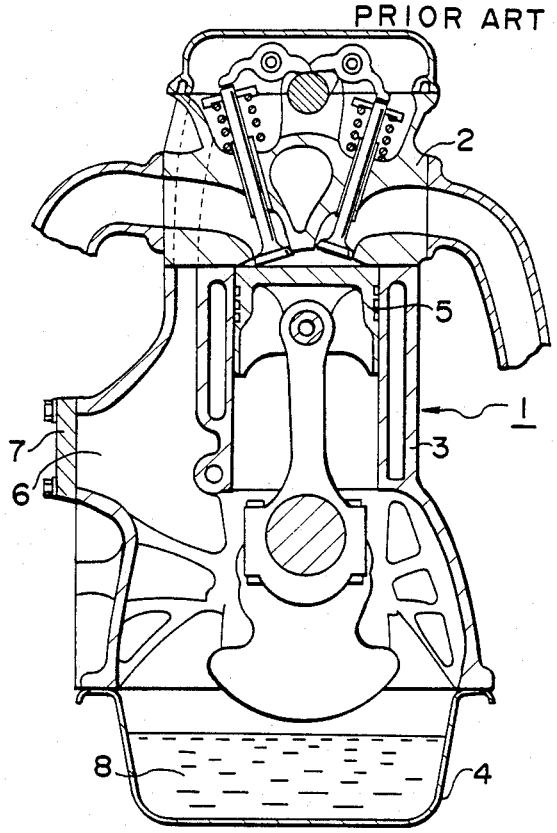
FIG. 6 PRIOR ART
FIG. 6 is a vertical sectional view of a conventional vertical in-line engine.
Figure 7:
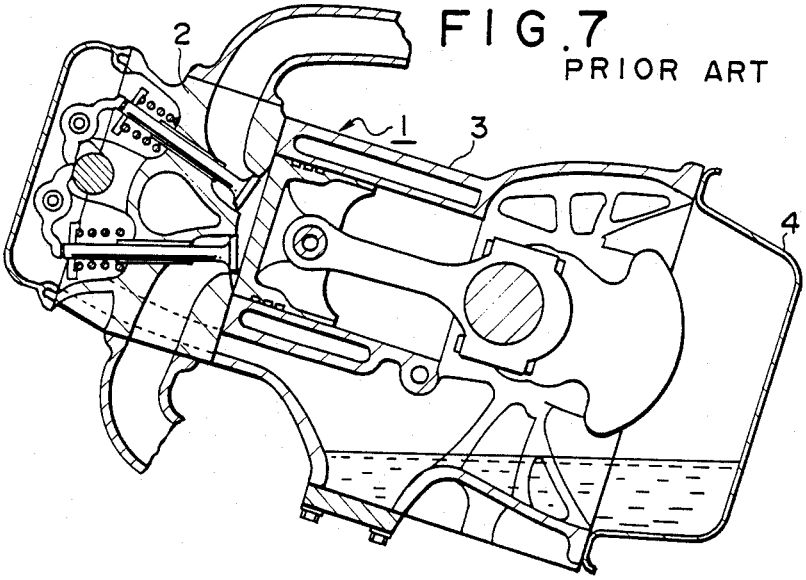
FIG. 7 PRIOR ART
FIG. 7 is a vertical sectional view of the engine shown in FIG. 6 when the engine is mounted in an inclined attitude.

On one side wall 22 of the cylinder block 21, an opening 23, used for removing casting sand when the cylinder block is cast, is provided. This opening 23 normally is closed by a plate 7 when the engine is mounted as a vertical in-line engine, as illustrated in FIG. 6. The engine 11 is mounted in a vehicle in a horizontal or nearly horizontal attitude with the opening 23 facing downward. In a multicylinder engine, the cylinder block 21 will have a plurality of openings 23 along the side wall 22. The openings 23 communicate with an oil return path 30 from the valve mechanism 14 on the cylinder head 12.

A cover 25 is provided at the location where an ordinary oil pan would be attached when the engine 11 is vertically mounted (refer to FIG. 6). The cover 25 has an opening 24 at the lowest portion thereof, that is, the bottom portion of the attached cover. Since this cover 25 is not used for storing oil but for leading oil to the opening 24, the capacity of the cover may be small. For instance, the cover 25 needs only to provide enough room for a crank rotation of the engine 11.

An adapter plate 26 is fastened to the lower side wall 22 of the cylinder block 21 and to the bottom portion of the cover 25, and the adapter plate extends at least from the opening 23 of cylinder block 21 to the opening 24 of cover 25. The adapter plate 26 has an attaching face **27*a* facing an attaching face 31*a* of the lower side wall 22 of cylinder block 21 and an attaching face 27*b* facing an attaching face 31*b* of the bottom portion of cover 25. Also, the adapter plate 26 has communication holes 28*a* aligned with the openings 23 of cylinder block 21 and a communication hole 28*b* aligned with the opening 24 of cover 25. The adapter plate 26 is fastened to the side wall 22 of cylinder block 21 and the bottom portion of cover 25 via appropriate connecting means such as bolts 32**.

Although the attaching face **31*a* of cylinder block 21 and the attaching face 31*b* of cover 25 are coplanar in this embodiment, they may not be. There may be any number of communication holes 28*a* and openings 23 and any number of communication holes 28*b* and openings 24. The adapter plate 26 has an extension 26*a* from the opening 23 of cylinder block 21 toward cylinder head 12, so that the space below cylinder block 21 is effectively utilized for an oil pan 29**.

The oil pan 29 is fastened to the lower surface of the adapter plate 26. Oil pan 29 extends over almost the entire area below the cylinder block 21 and the cover 25. The inside of oil pan 29 communicates with both openings 23 and 24 through communication holes **28*a* and 28*b***.

Figure 8:
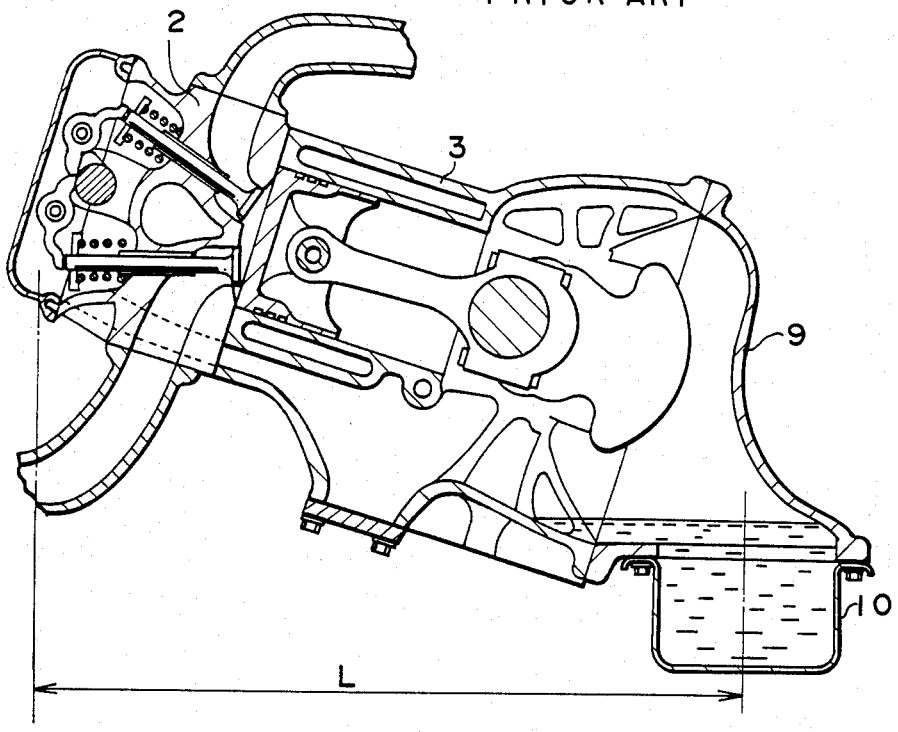
FIG. 8 PRIOR ART
FIG. 8 is a vertical sectional view of a conventional engine with an oil pan system modified from that of the engine shown in FIG. 6.
Figure 9:
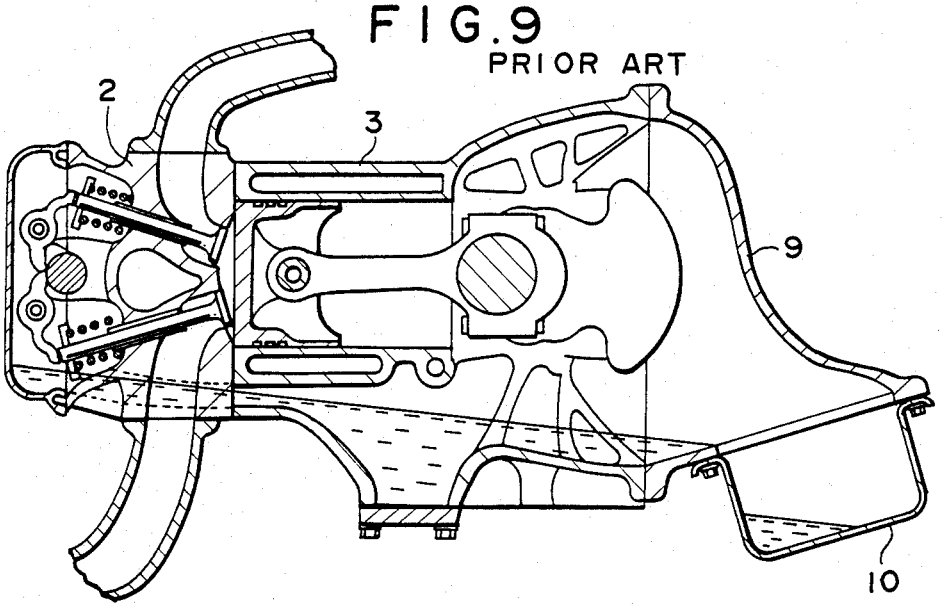
FIG. 9 PRIOR ART
FIG. 9 is a vertical sectional view of the engine shown in FIG. 8, showing a state when a vehicle is inclined or turned.

In this embodiment, the oil stored in the oil pan 29 is pumped through an oil strainer 32 and delivered by an oil pump (not shown), to various portions of the engine 11 (valve mechanism, piston-cylinder bore system, crankshaft system, etc.). After the oil lubricates the various portions of the engine 11, the oil flows by gravity back into oil pan 29 along path 30, as shown with arrows in FIG. 1. The oil pumped to the inside of cylinder head 12 returns into oil pan 29 mainly through openings 23 and communication holes **28*a*, and the oil pumped to the piston-cylinder bore system and crankshaft system returns into oil pan 29 both through opening 24 and communication hole 28*b* and through openings 23 and communication holes 28*a*. Thus the lengths of the oil return paths from portions to be lubricated to openings 23 and communication holes 28*a* or opening 24 and communication hole 28*b*, particularly the distance from valve mechanism 14 to openings 23 and communication holes 28*a*, is greatly shortened as compared with the distance (L) shown in FIG. 8, thereby speeding the return of oil into oil pan 29**.

Moreover, since oil pan 29 is always located below cylinder block 21 and cover 25, even if the angle of mounting the engine 11 is changed to some extent, the oil from portions to be lubricated returns smoothly into oil pan 29 without collecting in the return path.

FIG. 2 shows a state of the engine 11 and the oil in oil pan 29 when the vehicle is inclined or turned. Even in such a case, as the oil pan 29 is always located below the cylinder block 21, the oil in the oil pan can be prevented from flowing back into cylinder head 12. Moreover, since oil return passages through openings 23 and communication holes 28*a* and through opening 24 and communication hole 28*b* are always ensured, retention of oil in various portions of the engine 11 can be avoided.

As a result, an adequate amount of oil and an adequate level of oil in oil pan 29 are always assured, so that a sufficient supply to the oil pump is always maintained. Further, since the return of oil into oil pan 29 is increased and improved, the amount of oil to be initially deposited in oil pan 29 may be reduced.

Furthermore, since an otherwise conventional vertical in-line engine can be effectively mounted in a horizontal attitude merely by addition of an adapter plate and substitution of a cover and a different oil pan, and since the main portions of the conventional vertical in-line engine are used as they are, the production of an engine capable of being mounted both vertically and in a horizontal or nearly horizontal attitude can be increased.

Figure 4:
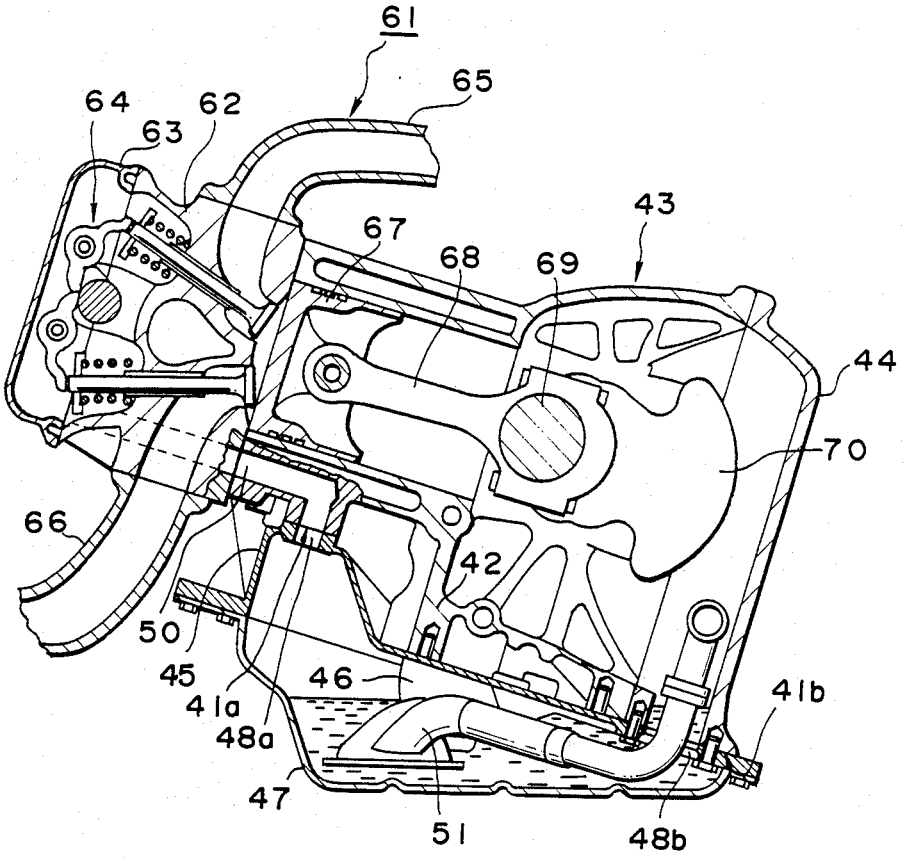
FIG. 4 is a vertical sectional view of an engine according to another embodiment of the present invention.
Figure 5:
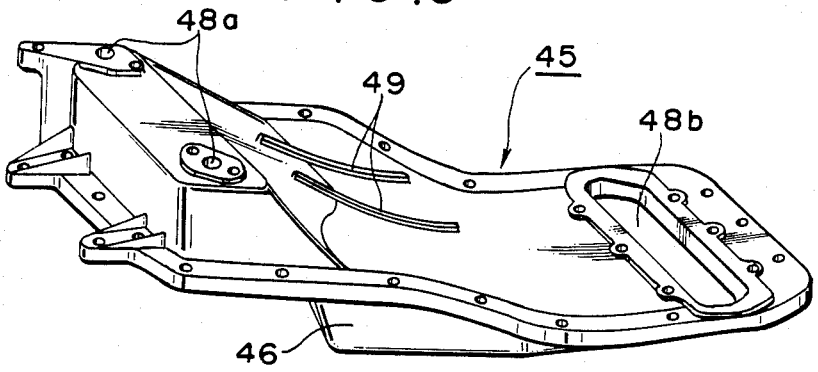
FIG. 5 is a perspective view of an adapter plate for an oil pan system of the engine shown in FIG. 4.

FIGS. 4 and 5 show another embodiment of the present invention.

In this embodiment, attaching faces 41*a* and 41*b* of the lower side wall 42 of a cylinder block 43 and of a cover 44 to which an adapter plate 45 is attached are planes different from each other. The adapter plate 45 is formed as shown in FIG. 5. The adapter plate 45 has a baffle plate 46 for the oil in an oil pan 47, ribs 49, communication holes 48*a* and communication hole 48*b*. Communication holes 48*a* are connected to oil return paths 50 more directly than in the aforementioned embodiment. The baffle plate 46 extends downward into the oil pan 47. An oil strainer 51 is provided in the oil pan 47, and the oil in the oil pan is pumped by an oil pump (not shown). Thus, there may be various combinations and various configurations of a cylinder block, an adapter plate and an oil pan are possible according to the invention. Numeral 61 refers to a main body of an engine which is designed as a vertical in-line engine. The engine 61 has a cylinder head 62, a head cover 63, valve mechanism 64 provided on the cylinder head, intake manifold 65, exhaust manifold 66, piston 67, connecting rod 68, crankshaft 69, balance weight 70 and cylinder block 43.

Although only several preferred embodiments of the present invention have been described in detail, it will be appreciated by those skilled in the art that various modifications and alterations can be made to the particular embodiments shown without materially departing from the novel teachings and advantages of this invention. Accordingly, it is to be understood that all such modifications and alterations are included within the scope of the invention as defined by the following claims.

What is claimed is:

1. An oil pan system for a vertical type in-line engine mounted in a vehicle in a horizontal or nearly horizontal attitude, said engine having a cylinder block with a lower side wall forming part of a crankcase and having an opening therethrough, said opening facing downward, wherein the oil pan system comprises:

a cover attached to said cylinder block at a location which corresponds to the location where an ordinary oil pan would be attached when said engine is vertically mounted, said cover having an opening at a bottom portion thereof adjacent to the lower side wall of the cylinder block;

an adapter plate having an upper surface attached to the lower side wall of said cylinder block and to the bottom portion of said cover, said adapter plate extending at least from said opening in the lower side wall of said cylinder block to said opening in the bottom portion of said cover, said adapter plate having a first communication hole communicating with said opening of said cylinder block and a second communication hole communicating with said opening of said cover; and an oil pan attached to a lower surface of said adapter plate, the inside of said oil pan communicating with both said openings through said first and second communication holes.

2. The oil pan system of claim 1, wherein said opening in the lower side wall of said cylinder block is an opening used for removing casting sand.

3. The oil pan system of claim 1, wherein said opening in the lower side wall of said cylinder block communicates with an oil return path from a valve mechanism in a cylinder head of the engine.

4. The oil pan system of claim 1, wherein said cylinder block has a plurality of said openings in the lower side wall of said cylinder block.

5. The oil pan system of claim 1, wherein said cover closes the crankcase of said engine.

6. The oil pan system of claim 1, wherein attaching faces of the lower side wall of said cylinder block and of said cover to which said adapter plate is attached are coplanar.

7. The oil pan system of claim 1, wherein attaching faces of the lower side wall of said cylinder block and of said cover to which said adapter plate is attached are planes different from each other.

8. The oil pan system of claim 1, wherein said adapter plate has a baffle plate for the oil in said oil pan.

9. The oil pan system of claim 1, wherein an oil strainer is provided in said oil pan.

10. The oil pan system of claim 1, wherein said adapter plate further extends from said opening in the lower side wall of said cylinder block toward a cylinder head of said engine.

* * * * *